United States Patent [19]

Nakamura et al.

[11] Patent Number: 4,908,077

[45] Date of Patent: Mar. 13, 1990

[54] SCROLL MADE OF ALUMINUM ALLOY

[75] Inventors: Kouji Nakamura; Yukiji Ohshima, both of Tokyo; Hajime Kamio, Ihara, all of Japan

[73] Assignee: Oshida Patent Agency, Tokyo, Japan

[21] Appl. No.: 227,519

[22] Filed: Aug. 2, 1988

[30] Foreign Application Priority Data

Sep. 4, 1987 [JP] Japan ..... 62-220469

[51] Int. Cl.[4] ..... C22C 21/02

[52] U.S. Cl. ..... 148/437; 148/2; 148/11.5 A; 148/438; 148/439; 148/440

[58] Field of Search ..... 148/2, 11.5 A, 415, 148/416, 417, 437, 438, 439, 440

[56] References Cited

U.S. PATENT DOCUMENTS 4,715,903 12/1987 Asten et al. ..... 148/437

*Primary Examiner*—R. Dean

*Attorney, Agent, or Firm*—William J. Daniel

[57] ABSTRACT

Forged compressor scrolls are made of an aluminum-silicon alloy consisting essentially of 8.5 to 10.5% silicon and not more than 0.2% antimony wherein the silicon is present as eutectic particles having an average particle diameter in the range of 2 to 8 μm, the particles being uniformly dispersed with a degree of dispersion in the range of 10,000 to 30,000 particles/mm$^2$. Such scrolls are free of internal defects and have reduced susceptibility to seizing and cracking combined with high abrasion resistance.

6 Claims, 1 Drawing Sheet

SCROLL MADE OF ALUMINUM ALLOY

BACKGROUND OF THE INVENTION

1. Field of the Invention

This invention relates to a forged scroll of aluminum to be used as a component in a compressor for such a gas as air or gaseous paraffin hydrocarbon (hereinafter referred to as "Freon").

2. Description of the Prior Art

A scroll type compressor effects compression of a suction gas by two scrolls producing relatively rotational motions while keeping mutual contact. It attains the compression of the suction gas by causing crescent shaped compression spaces formed jointly by a fixed scroll and a rotating scroll to be decreased or contracted continuously from the outside to the inside. Since this scroll type compressor has higher reliability, smaller size, lower vibration and less noise than a reciprocating type compressor (using a piston), it has been finding rapidly growing utility in recent years.

It has been customary for these scrolls to be produced from cast iron or steel. Since these materials exhibit poor machinability, the scrolls are not easily produced with fully sufficient dimensional accuracy. Aluminum material which excels in machinability, therefore, has been attracting attention. Owing to its high machinability coupled with its inherent lightness, the use of the aluminum material in the place of the conventional materials has been becoming popular. For these scrolls, use has been made of abrasion-resistant aluminum alloys such as, for example, the AC-8A alloy which as specified in Japanese Industrial Standard (JIS) H5202 contains 11 to 13% by weight (hereinafter referred to simply as "%") of silicon and incorporates therein small amounts of copper, magnesium, and nickel (i.e. having the composition of 0.8 to 1.3% Cu, 11.0 to 13.0% Si, 0.7 to 1.3% Mg, not more than 0.1% Zn, not more than 0.8% Fe, not more than 0.1% Mn, 1.0 to 2.5% Ni, not more than 0.2% Ti, and the balance Al). Since the produced scrolls are required to possess a fine microstructure and contain absolutely no inner defects such as porosity, they are obtained by special casting methods such as squeeze casting.

Even when the scrolls are produced by subjecting the aluminum alloy described above to the special casting method just mentioned, it is not easy to ensure perfect absence of porosity from the molded products. The products obtained after machining are often found to exhibit flaws due to porosity. Thus, the manufacture of the scrolls by this method suffers from poor productivity.

When a compressor incorporating scrolls of aluminum alloy obtained by this method is put to use, it would be a serious drawback if the two scrolls were to adhere by seizure to each other, sustain cracks, or succumb to wear. Anodizing of machined scrolls has resorted to in an attempt to improve their wear and seizure resistance. But it has proved unsatisfactory and needs to be improved from a practical point of view.

SUMMARY OF THE INVENTION

An object of this invention is to provide scrolls of an aluminum alloy which possess a fine microstructure free from such inner defect as porosity and which, when used in a compressor, sustain neither seizure nor cracking and offer high resistance to abrasion.

To be specific, this invention is directed to scrolls produced by forging an aluminum-silicon type alloy containing 8.5 to 10.5% silicon and not more than 0.2% antimony, which scrolls are characterized by the fact that the average particle diameter of eutectic silicon present in the alloy is in the range of 2 to 8 $\mu$m and the degree of dispersion of particles appearing in a fractured surface of the alloy is in the range of 10,000 to 30,000 particles/mm$^2$.

The scrolls of aluminum alloy achieved by the present invention enjoy high practical utility because they are free from inner defects such as porosity which is often found in the conventional scrolls of aluminum alloy produced by the squeese casting method and because they possess excellent resistance to wear and seizure without anodizing.

The other objects and characteristic features of this invention will become more apparent from the description given in further detail hereinafter with reference to the accompanying drawings.

DETAILED DESCRIPTION OF THE PREFERRED EMBODIMENT

Figure 1:
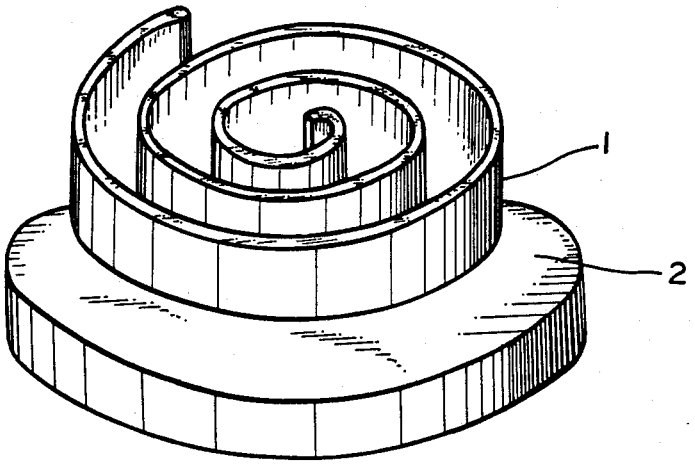
FIG. 1 is a perspective view illustrating a typical scroll obtained in accordance with the present invention.

The inventors have continued a study of the micro structure of aluminum scroll in search of a solution to the drawbacks suffered by the conventional scrolls of an aluminum-silicon type alloy as described above. They have consequently found that for the purpose of improving the resistance to abrasion and curbing the risk of seizure and crack, it is an indispensable requirement that the structure of the eutectic silicon should possess a proper particle diameter and should be uniformly dispersed in a proper state in the $\alpha$ phase.

The results of the inventors' study indicate that the scrolls can be obtained which operate without seizure and cracking and exhibit highly desirable resistance to abrasion without anodizing when made from an alloy used as the material therefor is such that the average diameter of the eutectic silicon particles in the alloy is in the range of 2 to 8 $\mu$m and the degree of dispersion of the particles of the eutectic silicon in the $\alpha$ phase is in the range of 10,000 to 30,000 particles/mm$^2$.

If the average particle diameter of the eutectic silicon exceeds the range mentioned above, the scrolls are liable to sustain cracks. Conversely if the average particle diameter is below the lower limit of the range, the scrolls are deficient in resistance to abrasion. If the degree of dispersion of the eutectic silicon particles exceeds the range, the alloy suffers from inferior machinability and the alloy itself is embrittled so much as to impair forgability. Conversely if it is below the lower limit of the range, the scrolls are liable to suffer from mutual adhesion by seizure.

In the present invention, the choice of the alloy composition as well as the method for production of the scrolls have been influenced by the desired alloy structure and the need for freedom from inner defects. For the purpose of eliminating the occurrence of inner defects such as porosity and enabling the eutectic silicon particles to be dispersed finely and discretely in the $\alpha$ phase to the fullest possible extent, it is desirable to adopt a method which comprises extrusion forming a cast alloy and forging the alloy. Otherwise, there may be adopted a method which forges cast billets directly and continuously.

For the sake of this invention, the aluminum-silicon alloy is desired to have a silicon content in the range of 8.5 to 10.5%.

In the present invention, the aluminum-silicon alloy of the aforementioned composition is formed in billets by the semi-continuous casting method in common practice and preferably subjecting the billets to extrusion. In the course of the production of billets by continuous casting, addition of not more than 0.2% antimony to the molten alloy proves to be a desirable measure for promoting the spherical structure of the eutectic silicon particles in the alloy.

In the practice of extrusion forming, the optimum extrusion ratio is in the range of 6 to 20. Then, the extrusion formed billets are heated to a temperature of 420° C.±20° C. and forged hot to make crude scrolls with substantially the desired dimensions and shape. The crude scrolls are given a $T_6$ treatment as generally practised and then subjected to the cutting work necessary for accurate finishing to in the specified dimensions. When a semi-continuously cast mass of aluminum-silicon type alloy containing silicon in the stated concentration is subjected to the two plastic processing of extrusion forming and hot forging in the manner described above, the eutectic silicon particles crystallized within the cast mass are properly subdivided and dispersed, to yield scrolls which have the eutectic silicon particles of a specified average diameter dispersed discretely within the $\alpha$ phase to a desired degree and which, therefore, enjoy freedom from inner defects and excel in resistance to seizure and abrasion. The aluminum-silicon alloy to be used for the present invention may contain, for the fortification of alloy quality, up to 4.0% copper, up to 1.8% magnesium, and up to 2.5% nickel without having any appreciable consequences on the results of this invention.

Now, the compressor scrolls made of aluminum alloy in accordance with the present invention will be described below with reference to working examples.

EXAMPLE 1

An aluminum-silicon type alloy incorporating therein 10% Si and 0.15% Sb was prepared. By the conventional semi-continuous casting process, this alloy was transformed into in billets 325 mm in diameter. Then, the billets were subjected to an extrusion operation forming long rods or bars 80 mm in diameter. From these long bars, cylinders 60 mm in length were cut out. These cylinders were heated to 425° C. and hot forged to obtain crude scrolls. These crude scrolls were subjected to a $T_6$ treatment (a solid solution treatment at 510° C.×4 hours followed by an artificial aging treatment at 170° C.×10 hours) and were subsequently machined to the desired dimensions and shape to give finished scrolls (having a vane (1) 20 mm in height with a outside diameter of 90 mm, of the vane (1) and 10 mm in height at the diameter, 130 mm) having the appearance of FIG. 1.

For comparison, an alloy of the same composition as the alloy used for the production of the scrolls of this invention was melted and subjected to the conventional squeeze casting treatment to form crude scrolls and these crude scrolls were machined to produce finished scrolls in the same dimensions and shape as those of the present invention. Then the finished scrolls were subjected to anodizing. Test pieces were cut from the vanes of the scrolls of this invention and those embodying the scrolls made by the conventional method. These test pieces were subjected to microscopic observation with respect to average particle diameter and particle dispersion of the eutectic silicon particles formed in the alloy structure. The test pieces were also subjected to frictional abrasion with a friction and wear tester (pressure of friction (A) 30 kg/cm$^2$ and (B) 150 kg/cm$^2$, distance of friction 5 km, and speed of friction surface 1 m/sec; with the friction made with the same material as the test piece). At the end of the abrasion test, the test pieces were weighed to find amounts lost or wear due to frictional abrasion. The results are shown in Table 1.

TABLE 1

| | | Product of this invention | Prior art product |
|---|---|---|---|
| Average particle diameter (μm) | | 5 | 22 |
| Degree of dispersion of particles (Number of particles/mm$^2$) | | 15,000 | 4,000 |
| Shape of particles | | spherical | Needle-like |
| Amount of wear (mg) | A | 0 | 1.4 |
| | B | 0.2 | Seizure |

From the results of Table 1, it is clearly noted that the scrolls of the present invention having the eutectic silicon particles of an average diameter conforming with this invention dispersed in a specified degree within the $\alpha$ phase far excelled the scrolls of the conventional method in quality as evidenced by the fact that the resistance to abrasion were remarkably superior to that of the conventional scrolls and did not suffer the phenomenon of seizure even at an increased friction pressure.

EXAMPLES 2 TO 6

Next, the test pieces taken from the scrolls of the present invention obtained in Example 1 was subjected to the same frictional abrasion test as in Example 1 (pressure of friction 30 kg/cm$^2$, distance of friction 5 km, and speed of friction 1 m/sec), except that different materials were used for the opposed friction surface. The identity of the test pieces and the materials used for the opposed friction surface and the amounts of loss by abrasion found by weighing (A for test piece and B for the opposed friction material are given in Table 2. (In Example 6, the test piece was taken from the prior art scrolls made by the conventional method and the opposed friction material was taken from the product of this invention.)

TABLE 2

| Example No. | Test piece | Opposed friction material | A | B |
|---|---|---|---|---|
| 2 | This invention | Cast iron | 0.1 | 0.6 |
| 3 | This invention | Steel nitride | 0.02 | 0.2 |
| 4 | This invention | This invention | 0 | 0 |
| 5 | This invention | Prior Art Alloy | 0.01 | 0.3 |
| 6 | Prior Art Alloy | This invention | 1.8 | 0 |

It is noted from the results given above that the test pieces taken from the scrolls of this invention experienced only minimal wear even when they were subjected to friction against such iron and steel materials as cast iron and steel nitride. These results indicate that the scrolls may be used in combination with such iron and steel material and, therefore, may find utility in a wide range of applications.

What is claimed is:

1. Compressor scrolls forged from an aluminum-silicon type alloy consisting essentially of 8.6 to 10.5% by weight of silicon the silicon being present as eutectic particles having an average particle diameter in the range of 2 to 8 μm, which particles are uniformly dispersed with a degree of dispersion is in the range of 10,000 to 30,000 particles/$mm^2$.

2. The scrolls according to claim 1, wherein said aluminum-silicon type alloy further contains not more than 0.2% by weight of antimony.

3. The scrolls according to claim 1, wherein said aluminum-silicon type alloy further contains not more than 4.0% by weight of copper, not more than 1.8% by weight of magnesium, and not more than 2.5% by weight of nickel.

4. The scrolls according to claim 1, wherein the forged scrolls are obtained by casting said aluminum-silicon alloy into billets by a semi-continuous casting method, subjecting said billets to an extrusion forming treatment, and subsequently hot forging the extrusion formed pieces.

5. The scrolls according to claim 4, wherein said extrusion forming is carried out at an extrusion ratio in the range of 6 to 20.

6. The scrolls according to claim 4, wherein said hot forging is carried out at a temperature of 420° C.±20° C.

* * * * *